US006648628B2

(12) United States Patent
Eiklor

(10) Patent No.: US 6,648,628 B2
(45) Date of Patent: Nov. 18, 2003

(54) GAS FLOW MUFFLING DEVICE

(76) Inventor: Scott F. Eiklor, 1047 E. Smith Cir., Paoli, IN (US) 47454

( * ) Notice: Subject to any disclaimer, the term of this patent is extended or adjusted under 35 U.S.C. 154(b) by 387 days.

(21) Appl. No.: 09/799,167

(22) Filed: Mar. 5, 2001

(65) Prior Publication Data

US 2003/0154972 A1 Aug. 21, 2003

(51) Int. Cl.[7] ..... F23D 14/10; F23D 14/00

(52) U.S. Cl. ..... 431/114; 431/125; 431/354; 126/572; 181/229

(58) Field of Search ..... 431/230, 114, 431/240, 125, 346, 355, 241, 354, 232, 233, 234, 235, 236, 237, 244; 126/39 R, 41 R, 92 AC, 512; 239/432, 553, 553.3, 552; 60/725; 181/229

(56) References Cited

U.S. PATENT DOCUMENTS

| | | | | | |
|---|---|---|---|---|---|
| 14,414 | A | * | 3/1856 | Shaw | 239/430 |
| 805,593 | A | * | 11/1905 | Thayer | 431/240 |
| 949,676 | A | * | 2/1910 | Davis | 431/346 |
| 1,086,150 | A | * | 2/1914 | Frampton | 239/553.3 |
| 1,143,057 | A | * | 6/1915 | Meacham | 239/432 |
| 1,354,295 | A | * | 9/1920 | Hamilton | 239/432 |
| 1,354,856 | A | * | 10/1920 | Slinack | 431/240 |
| 1,368,120 | A | * | 2/1921 | Cole | 239/553.3 |
| 1,485,129 | A | * | 2/1924 | Smith | 431/346 |
| 1,503,042 | A | * | 7/1924 | Gosmann | 431/346 |
| 1,510,024 | A | * | 9/1924 | Warner | 431/240 |
| 2,045,956 | A | * | 6/1936 | Lenk | 431/241 |
| 2,091,528 | A | * | 8/1937 | Schreyer | 431/320 |
| 2,504,584 | A | * | 4/1950 | Ramos | 431/325 |
| 2,829,511 | A | * | 4/1958 | Oesterle et al. | 431/325 |
| 3,695,290 | A | | 10/1972 | Evans | |
| 3,785,405 | A | | 1/1974 | Quinn | |
| 3,994,674 | A | * | 11/1976 | Baumann et al. | 431/354 |
| 4,024,891 | A | | 5/1977 | Engel et al. | |
| 4,041,982 | A | | 8/1977 | Lindner | |
| 4,150,696 | A | | 4/1979 | Meier et al. | |
| 4,567,915 | A | | 2/1986 | Bates et al. | |
| 4,739,795 | A | | 4/1988 | Ewbank et al. | |
| 5,018,703 | A | | 5/1991 | Goode | |
| 5,027,919 | A | | 7/1991 | Silva et al. | |
| 5,033,455 | A | | 7/1991 | Eiklor et al. | |
| 5,730,416 | A | | 3/1998 | Welker | |
| 5,901,750 | A | | 5/1999 | Kozinski | |
| 5,924,673 | A | | 7/1999 | Welker | |
| 5,938,430 | A | * | 8/1999 | Majerowski | 431/320 |

* cited by examiner

*Primary Examiner*—Carl D. Price
(74) *Attorney, Agent, or Firm*—Wallenstein Wagner & Rockey Ltd.

(57) ABSTRACT

The invention is a device for muffling the sound of escaping gas from a dispensing pipe for natural gas or any similar gaseous fuel, where the dispensing pipe has one or more first orifices. The device is an insert that may be placed into the dispensing pipe. The insert has second orifices through which the natural gas or any similar gaseous fuel escapes, and the second orifices are smaller than the first orifices.

6 Claims, 2 Drawing Sheets

GAS FLOW MUFFLING DEVICE

TECHNICAL FIELD

This invention relates generally to a muffling device for use in an artificial log fireplace.

BACKGROUND OF THE INVENTION

Gas-fired burners for fireplaces are well-known. These gas-fired burners are placed at the base of fireplaces in homes and commercial buildings, such as restaurants. Typically, these gas-fired burners include a gas supply pipe, orifices through which gas escapes, and simulated logs and embers. These gas-fired burners are cleaner than wood-burning fireplaces, do not require the acquisition, transporting, and chopping of wood, and yet provide a fire that closely simulates a natural wood-burning fire.

United States patents describing such burners included U.S. Pat. No. 5,033,455 ("the '455 patent"). As may be seen in the '455 patent, gas-fired burners typically include a pair of gas pipes 16 and 18. Gas pipe 16 is disclosed in the '455 patent as having five orifices 26, while gas pipe 18 is disclosed as having twenty-six orifices 28. As may be seen in FIG. 2 of the '455 patent, these orifices 26 and 28 face downwardly. In practice, these orifices 26 and 28 are covered by sand or a similar substance. To start the gas-fired burner, a natural gas valve is opened, and the gas moves through the orifices 26 and 28 and then through the sand. As the natural gas is diffused through the sand, it is ignited by a match placed near the surface of the sand. There is no appreciable noise created when this natural gas passes through these orifices 26 and 28 and then the sand.

Certain governmental authorities have discouraged or prohibited the use of sand in such natural gas-fired burners. In the view of these authorities, the sand poses a potential hazard to children, who may unknowingly ingest the sand.

In some instances, to comply with these regulations, gas-fired burners have been used without any kind of sand. In other instances, as a replacement for the sand, either glowing embers or lava rocks have been used at the bottom of these orifices. When the natural gas escapes from these orifices 26 and 28 and then passes through these glowing embers or lava rocks, a loud rushing or whistling sound is created. This loud rushing or whistling sound is unacceptable in residential or commercial installations. Accordingly, there is a need for a method or device that muffles the rushing or whistling sound of the escaping gas in natural gas-fired burners that do not use sand.

SUMMARY OF THE INVENTION

The invention is a device for muffling the sound of gas escaping from a pipe dispensing natural gas or any other suitable gaseous fuel. The device comprises a braided metallic element of a given length. The braided metallic element has an inlet end and an outlet end. A braided fibrous element surrounds at least a portion of the braided metallic element. The braided metallic element is crimped at its outlet end.

In a most preferred aspect, the braided metallic element is made of bronze. That most preferred embodiment also includes a braided fibrous element that is made of a fiberglass or a ceramic material.

Alternatively, the braided fibrous element is made of a cotton material.

The invention is also a device for muffling the sound of escaping gas from a pipe dispensing natural gas or any other suitable gaseous fuel. The dispensing pipe has one or more first orifices. The device further comprises an enclosure into which the natural gas or any other suitable gaseous fuel flows. The enclosure includes second orifices along the exterior of that enclosure through which the natural gas or any other suitable gaseous fuel escapes. These second orifices are smaller than the first orifices.

The invention is also a device for muffling the sound of escaping gas from a dispensing pipe for natural gas or any other suitable gaseous fuel. The dispensing pipe has one or more first orifices. The device itself comprises an insert that may be placed into the dispensing pipe. The insert has second orifices through which the natural gas or any other suitable gaseous fuel escapes. The second orifices are smaller than the first orifices, and preferably substantially smaller than the first orifices. For example, the first orifices may be between approximately 1/16th of an inch and 1/8th of an inch. The second orifices are typically substantially less than 1/64th of an inch. Preferably, the insert is made of a metallic braided element, and the insert is at least partially surrounded by a fibrous braided element.

DETAILED DESCRIPTION

This invention is susceptible of many different embodiments. The drawings and the description detail preferred embodiments of the invention. It should be understood that the present disclosure is to be considered as an example of the principles of the invention. It is not intended to limit the broad aspect of the invention to the illustrated embodiments.

Figure 1:
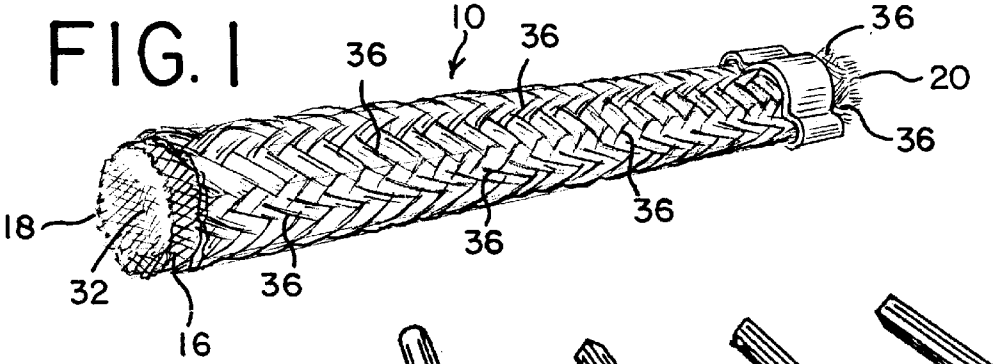
FIG. 1 is perspective view of one embodiment of the invention.
Figure 2:
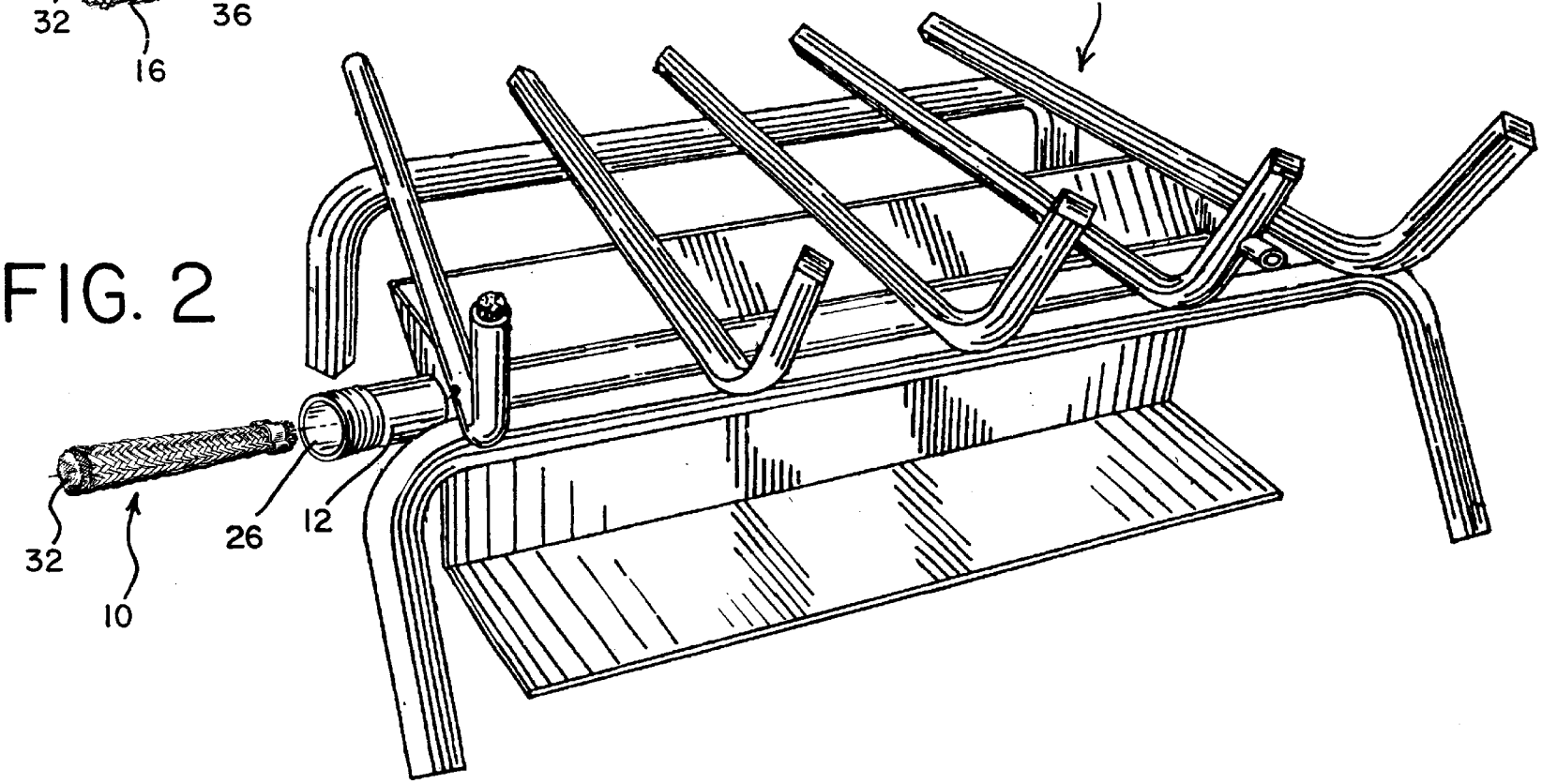
FIG. 2 is a view of the embodiment of FIG. 1, positioned adjacent and ready for insertion into the gas dispensing pipe of a gas-fired burner.

As may best be seen in FIG. 1, the invention is a device 10 for muffling the sound of gas escaping from a pipe 12 that dispenses natural gas or any other suitable gaseous fuel. This pipe 12 dispensing natural gas or any other suitable gaseous fuel is a part of an artificial gas-fired burner of the kind well-known in the art. One example of an artificial gas-fired burner 14 in which this device 10 can be used is shown in FIG. 2. While some prior art artificial gas-fired burners 14, such as those shown in U.S. Pat. No. 5,033,455, can include two gas dispensing pipes, the device 10 of the present invention can be used in gas-fired burners having any number of gas dispensing pipes. The artificial gas-fired burner 14 shown in FIG. 2 uses one gas dispensing pipe 12.

Figure 5:
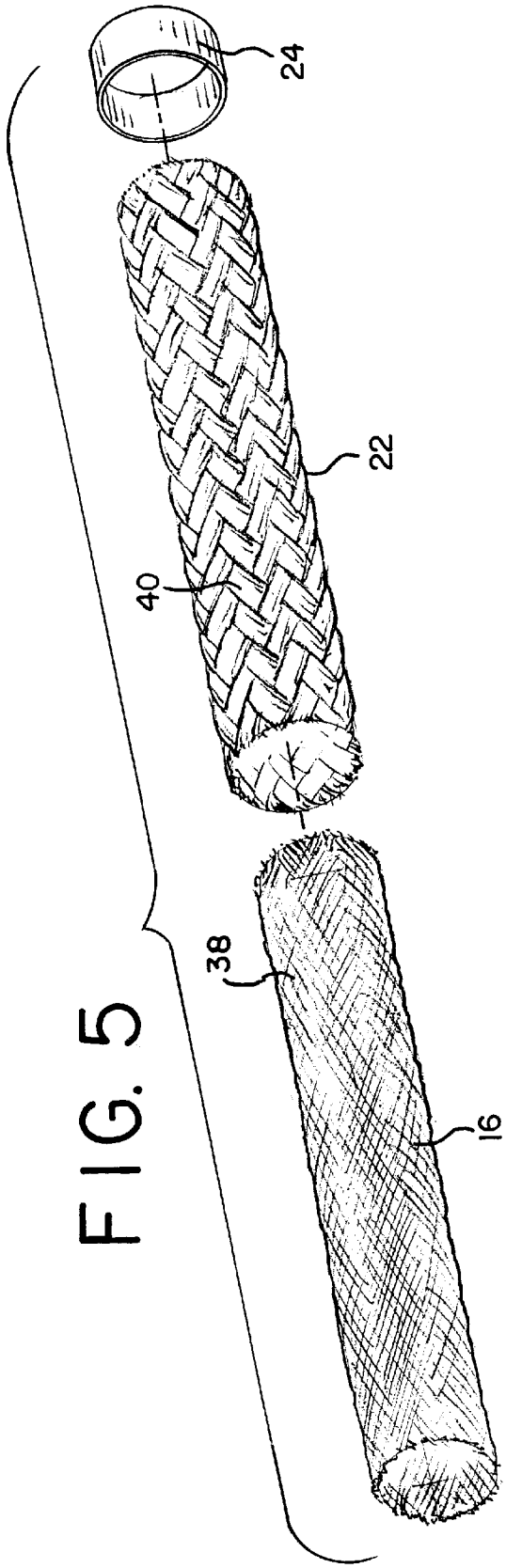
FIG. 5 is an exploded view, prior to assembly, of the components that make up the device of the embodiment of FIG. 1.

While FIG. 1 shows an assembled device 10 in accordance with one embodiment of the invention, FIG. 5 shows this same device 10 in exploded form, in the manner in which it would appear prior to its assembly. Referring now to FIG. 5, one of the elements of the device 10 is a braided metallic element 16 of a given length. In this embodiment, the braided metallic element 16 has a length of three to four inches, and an internal diameter ranging from approximately ¼ inch to ½ inch. The most preferred braided metallic element 16 is made of a bronze material. An example of a most preferred ¼" braided metallic element 16 is available in bulk form from Metal Flex Sales, St. Louis, Mo. (Tel. (314) 521-3023). The braided metallic element 16 has both an inlet end 18, where the gas enters the device, and an outlet end 20, where at least a portion of the gas ultimately exits the device 10.

As may further be seen in FIGS. 1 and 5, the device 10 also includes a braided fibrous element 22. Like the braided metallic element 16, the braided fibrous element 22 has a length of approximately three to four inches, and a diameter of between ¼" and ½". Because the braided fibrous element 22 surrounds at least a portion of the braided metallic element 16, as may best be seen in FIG. 1, the braided fibrous element 22 should have a slightly larger inner diameter than the outer diameter of the braided metallic element 16. Alternatively, the braided fibrous element 22 should have the ability to expand radially, so that it can grow to accommodate the outer diameter of the braided metallic element 16. One example of a preferred braided fibrous element 22 is available as a fiberglass packing, Part No. 8819K44, having a ¼" diameter, usable to up to 1000 degrees Fahrenheit, and available in amounts up to one hundred feet, available from McMaster Carr Products, Chicago, Ill. (Tel. (630) 833-0300). Alternatively, the braided fibrous element 22 may be made of a ceramic fabric or a cotton fabric.

The braided metallic element 16 is crimped at its outlet end 20. Alternatively, the braided metallic element 16 and the braided fibrous element 22 are together crimped adjacent the outlet end 20 of the braided metallic element 16. Obviously, this crimping at the outlet end 20 of the braided metallic element 16 decreases the effective size of the outlet end 20. As a result, there is more restriction to the passage of gas through this crimped outer end 20. The clamp 24 that creates the force for crimping is an adjustable clamp, also available from McMaster Carr Products of Chicago, Ill., (tel. (630) 833-0300) as Part No. 52545K42. The clamp 24 is a staple-less ear hose clamp. It is a ⅜" size clamp 24, and that clamp 24 can be used for a diameter range of 5⁄16" to ⅜".

The components of FIG. 5 are assembled by sliding the braided fibrous element 22 over the braided metallic element 16. The clamp 24 is then placed over at least the outlet end 20 of the braided metallic element 16, and adjusted to radially compress the outlet end 20 as much as possible. The device 10 is now fully assembled, and ready for use, as may be seen in FIG. 1.

As may be seen in FIG. 2, the device 10 is inserted into one end 26 of the gas dispensing pipe 12 of the artificial gas-fired burner 14. After insertion into this end 26 of the gas dispensing pipe 12, a natural gas supply pipe (not shown) from the residence or commercial establishment is connected to this end 26. The artificial gas-fired burner 14 is now ready for use.

It is unnecessary to secure the device 10 into the gas dispensing pipe 12. There are two reasons for this. First, the natural gas or any other suitable gaseous fuel being supplied to the gas dispensing pipe 12 has a pressure of only about ½ psig. Second, the device 10 has an outer diameter greater than the inner diameter of the gas dispensing pipe 12. As a result, upon insertion of the device 10 into the gas dispensing pipe 12, the user manually compresses the exterior of the device 10 so as to cause that device 10 to be initially compressed to a size sufficiently small to enter the gas dispensing pipe 12. When the device 10 is released by the user upon full insertion into the gas dispensing pipe 12, the device 10 attempts to reassume its original, uncompressed outer diameter. The device 10 is prevented from reassuming this diameter by the inner walls 28 of the gas dispensing pipe 12. Nevertheless, as the device 10 attempts to reassume its original, uncompressed outer diameter, its outer walls 30 press against the inner walls 28 of the gas dispensing pipe 12. This in turn helps to retain the device 10 in its place within the gas dispensing pipe 12, in the position shown in FIG. 3.

As noted above, the invention is a device 10 for muffling the sound of escaping gas from a pipe 12 dispensing natural gas. It will be understood that the device 10 itself may comprise an insert of virtually any shape that may be placed into the dispensing pipe. In the shape shown in FIGS. 1–5, the device 10 further includes an enclosure 32 or hollow pocket into which the natural gas flows.

Figure 3:
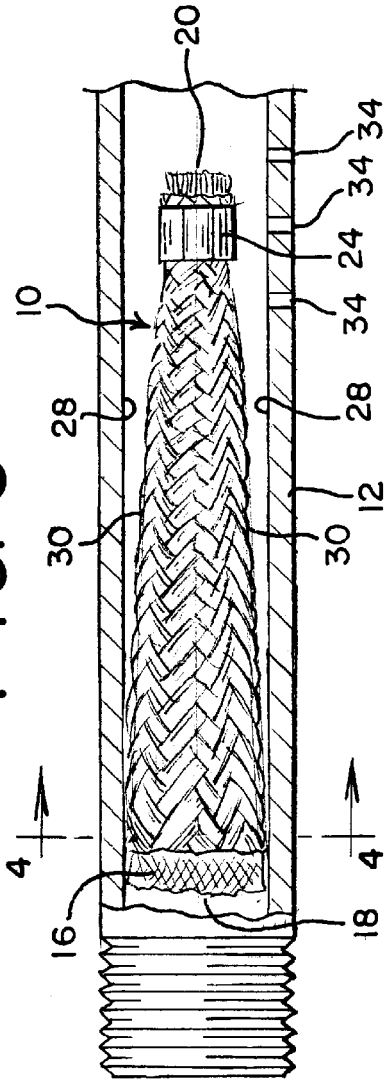
FIG. 3 is an enlarged, sectional view of a portion of the gas dispensing pipe of the gas-fired burner of FIG. 2, with the device of FIG. 1 inserted in its normal position within the gas dispensing pipe.

As may best be seen in FIG. 3, the gas dispensing pipe 12 has one or more first orifices 34. These first orifices 34 dispense the natural gas that feeds the flames in the artificial gas-fired burner 14. For example, the first orifices 34 may be between approximately 1⁄16 th of an inch and ⅛ th of an inch in diameter.

After the natural gas enters the enclosure or pocket 32 of the device 10, it exits the device 10 through a plurality of second orifices 36. These second orifices 36 are typically substantially smaller than the first orifices 34.

In the embodiment of the device 10 shown in FIGS. 1–5, the second orifices are in one of two general areas. First, some of the second orifices 36 are located at the outlet end 20 of the braided metallic element 16. At this outlet end 20, the metallic fibers are compressed to create small openings between those fibers. These openings comprise the second orifices 36 at the outlet end 20.

The remainder of the second orifices are located along, and are cooperatively formed by, the walls of the braided metallic element 16 and the braided fibrous element 22, respectively. As may be best seen in FIG. 5, the braided metallic element 16 and the braided fibrous element 22 both include sidewalls 3 8 and 40, respectively. As a consequence of the particular crosshatched, loosely woven construction of these braided metallic 16 and braided fibrous elements 22, these sidewalls 38 and 40 are porous. These pores in both the sidewalls 38 and 40 of the elements 16 and 22 cooperatively create the second orifices 36 in these sidewalls. The gas that does not escape the device through the second orifices 36 near the outlet end 20 of braided metallic element 16 instead escapes through the second orifices 36 positioned along the exterior sidewalls 38 and 40 of the braided metallic 16 and braided fibrous elements 22, respectively.

Figure 4:
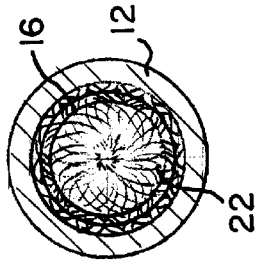
FIG. 4 is a cross-sectional view, taken along lines 4—4 of FIG. 3, of one end of the gas dispensing pipe, with the device of the embodiment of FIG. 1 positioned within that gas dispensing pipe.

It is not completely understood why the present device 10 muffles the sound of the gas escaping from the larger, first orifices 34. It is possible that the gas moving through the larger, first orifices 34 in a gas pipe without the device 10 approaches those orifices in a laminar flow pattern, and that that laminar flow pattern results in the loud noise. In contrast, with the device 10 positioned within the gas pipe as shown in FIGS. 3–4, it is believed that the gas moving through and then leaving that device 10 may instead approach those orifices 34 in a turbulent flow pattern, and it may be that the sound is reduced as a result of this turbulent flow pattern.

Specific embodiments have been illustrated and described. Numerous modifications are possible without significantly departing from the spirit of the invention. The scope of protection is only limited by the scope of the accompanying Claims.

I claim:

1. A device for muffling the sound of gas escaping from a pipe dispensing natural gas or any other suitable gaseous fuel, comprising (a) a braided metallic element of a given length, said braided metallic element having an inlet end and an outlet end; (b) a braided fibrous element surrounding at least a portion of said braided metallic element; and (c) said braided metallic element being crimped at its outlet end.

2. The device of claim 1, wherein said braided metallic element is made of bronze.

3. The device of claim 1, wherein said braided fibrous element is made of a fiberglass material.

4. The device of claim 1, wherein said braided fibrous element is made of a cotton material.

5. The device of claim 1, wherein said braided fibrous element is made of a ceramic material.

6. A device for muffling the sound of escaping gas from a dispensing pipe for gas, said dispensing pipe having one or more first orifices, said device comprising an insert that may be placed into said dispensing pipe, said insert having second orifices through which said gas escapes, wherein said insert is made of a metallic braided element, and wherein said insert is at least partially surrounded by a fibrous braided element, said second orifices being smaller than said first orifices.

* * * * *